US006508096B1

(12) United States Patent
Carlile

(10) Patent No.: US 6,508,096 B1
(45) Date of Patent: Jan. 21, 2003

(54) PROCESS FOR DRAWING AND STRETCHING SHEET METAL

(75) Inventor: Gary Carlile, San Marcos, CA (US)

(73) Assignee: Versaform Corp., Oceanside, CA (US)

( * ) Notice: Subject to any disclaimer, the term of this patent is extended or adjusted under 35 U.S.C. 154(b) by 0 days.

(21) Appl. No.: 09/615,611

(22) Filed: Jul. 14, 2000

(51) Int. Cl.[7] ..... B21D 25/02
(52) U.S. Cl. ..... 72/297; 72/302
(58) Field of Search ..... 72/296, 297, 302

(56) References Cited

U.S. PATENT DOCUMENTS

| | | | | | |
|---|---|---|---|---|---|
| 2,850,071 | A | * | 9/1958 | Kraybill | 72/297 |
| 2,961,028 | A | * | 11/1960 | Bath | 72/297 |
| 3,113,607 | A | * | 12/1963 | Maize | 72/296 |
| 3,452,573 | A | * | 7/1969 | Mackenzie | 72/296 |
| 4,747,292 | A | * | 5/1988 | Chorneau | 72/297 |
| 5,676,080 | A | * | 10/1997 | Allen | 72/296 |
| 6,145,466 | A | | 11/2000 | Herbein et al. | |

* cited by examiner

*Primary Examiner*—Daniel C. Crane
(74) *Attorney, Agent, or Firm*—Hedman & Costigan, P.C.

(57) ABSTRACT

A draw stretch process is provided for shaping a workpiece initially comprising an elongated metal sheet having a pair of spaced opposite ends. The process involves placing the metal sheet in a metal forming position in a draw stretch forming machine between a bulldozer having a female forming surface and a die having a male forming surface. The sheet is positioned such that the ends thereof project laterally outwardly beyond the forming surfaces. The forming surfaces are complemental and configured to draw the metal sheet into a predetermined shape. The bulldozer is moveable relatively toward the die from a draw initiating position where it is adjacent the metal sheet to a fully closed metal sheet shaping position. The draw initiating position and the fully closed position are spaced apart a predetermined distance. The work piece is partially drawn by moving the bulldozer toward the die with the work piece therebetween from the draw initiating position to a working position located between the draw initiating position and the fully closed position. The partially drawn is stretched by pulling outwardly on the ends thereof after the bulldozer has reached its working position and the stretching is continued until any puckering or gathers in the work piece are relieved. The drawing of the work piece is completed by moving the bulldozer toward the die with the relieved work piece therebetween from the working position to the fully closed position to thereby give said workpiece its final predetermined shape. The fully shaped work piece is then stretched again by pulling outwardly on the ends thereof after the bulldozer has reached its fully closed position to thereby give the shaped work piece memory, to set its shape, and to work harden the same. The fully shaped and work hardened work piece may be formed from a corrosion resistant aluminum and used as a component in the hull of a boat.

12 Claims, 2 Drawing Sheets

PROCESS FOR DRAWING AND STRETCHING SHEET METAL

BACKGROUND OF THE INVENTION

1. Field of the Invention

The present invention relates to a process for drawing and stretching sheet metal and particularly to such a method for forming a stretch drawn work hardened boat hull from corrosion resistant aluminum.

2. The Prior Art

Processes for forming shapes from sheet metal by stretch drawing are well known. These processes generally involve forming a preform by placing a work piece consisting of a piece of sheet metal between the bulldozer and the die of a stretch-forming machine, stretching the sheet metal to approximately 25% of its yield strength, and driving the bulldozer to about 75% of its final depth. At this point it is conventional to remove the preform and subject it to solution heat treatment. The heat treated preform is then reloaded in the stretch-forming machine, the bulldozer is set at its previous depth, the preform is stretched again to about 25% of yield, the bulldozer is taken to 100% of its design depth, and finally the material of the workpiece is again stretched, this time for an additional 1½ to 3% of yield. These procedures are time consuming and expensive and the same have generally been thought to be limited to use in connection with pieces of sheet metal no greater in size than about 48" by about 60"and to a draw of no more than about 8". The prior art procedures have also been thought to be limited to shapes which are not overly complex. These limitations, which are well known to the routineers in the stretch draw forming art, are imposed as a result of the difficulty in handling larger preforms and because of the tendency for friction lock to occur when the desired shapes become too complex. The prior art process have also been limited to use with heat treatable materials because it has not been possible using conventional techniques to produce final shapes which have been sufficiently work hardened. That is to say, those skilled in the art have previously believed that parts which are 260" long could not be formed using stretch draw methodology. Moreover, draws of 20" or so have been unheard of. These problems have been exacerbated when the materials to be formed are not suitable for being hardened by heat treatment. For example, aluminum to be used in forming a boat must be corrosion resistant, and corrosion resistant aluminum is not amenable to heat treatment hardening.

SUMMARY OF THE INVENTION

The problems encountered in prior art processes discussed above are ameliorated if not eliminated completely through the use of the present invention which provides a stretch draw process for shaping a workpiece initially comprising an elongated metal sheet having a pair of spaced opposite ends. The process involves a completely new series of steps. Initially the metal sheet to be formed is placed in a metal forming position in a draw stretch forming machine between a bulldozer having a female forming surface and a die having a male forming surface. Preferably the sheet is positioned such that said ends thereof project laterally outwardly beyond the forming surfaces of the bulldozer and die. The forming surfaces are complemental and configured to draw the metal sheet into a predetermined shape. The bulldozer is moveable relatively toward the die from a draw initiating position where it is adjacent the metal sheet to a fully closed metal sheet shaping position. The draw initiating position and the fully closed position are spaced apart a predetermined distance. Initially the bulldozer is moved from a fully open position where access is provided for loading the work piece into the machine. The bulldozer is then moved into its draw initiating position where it just touches the metal sheet. The ends of the metal sheet are then pulled outwardly to eliminate the slack and position the same in its correct position for being formed. During this slack removing procedure, the metal sheet is preferably not stretched.

The metal sheet work piece is partially drawn toward is desired shape by moving the bulldozer toward the die with the work piece therebetween. During this operation the bulldozer is moved from its draw initiating position to a working position located between the draw initiating position and its fully closed position. In accordance with the invention, the partially drawn work piece is stretched by pulling outwardly on the ends thereof after the bulldozer has reached its working position, and the stretching is continued until any puckering or gathers in the work piece are relieved. After the puckering and/or gathers are relieved, the drawing of the work piece is completed by moving the bulldozer toward the die with the relieved work piece therebetween from the bulldozer working position to bulldozer fully closed position to thereby give the workpiece its final predetermined shape. The shaped work piece is stretched again after the bulldozer has reached its fully closed position by pulling outwardly on the ends thereof to thereby give the shaped work piece memory, set its shape, and work harden the same.

In a preferred form of the invention, the bulldozer working position may be closer to the fully closed position than it is to the draw initiating position. Preferably, the ratio of the distance between the working position and the draw initiating position to the distance between the working position and the fully closed position ranges from about 1.5:1 to about 19:1, more preferably from about 2.33:1 to about 9:1, even more preferably from about 4:1 to about 7:1 and ideally such ratio is approximately 5.67:1.

In a particularly preferred form of the invention, the metal of the metal sheet work piece is a corrosion resistant aluminum, and ideally is 5052 aluminum. Specifically the invention is particularly useful for forming boat hull components. For these purposes, it is preferred that the metal sheet work piece is at least about 15 feet long, and ideally the same may be approximately 20–25 feet long.

DETAILED DESCRIPTION OF PREFERRED EMBODIMENTS OF THE INVENTION

Figure 1:
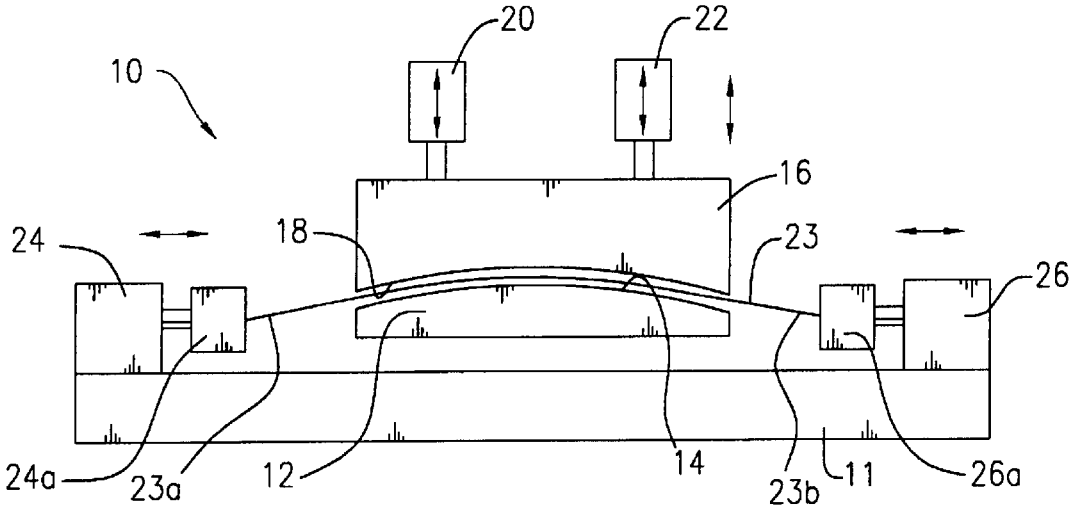
FIG. 1 is a schematic view of draw stretch forming machine illustrating the metal sheet forming process of the invention.

A stretch draw forming machine which is useful in performing the processes which utilize the concepts and principles of the invention is illustrated in FIG. 1, where the machine is identified by the reference numeral 10. The machine 10 is a conventional machine which includes an elongated base 11, a stationary die 12 having a male forming surface 14 mounted on the base 11 and a moveable bulldozer 16 having a female forming surface 18. Generally speaking, dies such as the die 12 are formed from a by machining a solid block of steel into the desired shape inside mold lines. The die is then rigged on the base in an attitude that is most conducive to the forming process. Bulldozers such as the bulldozer 16 are often formed as a steel box and egg crate structure that has a laminated epoxy and fiberglass face conforming to the desired outside mold lines. This structure may then be filled with a resin slurry to increase the rigidity of the structure.

The machine 10 also includes a mechanism for moving bulldozer 16 toward and away from die 12 in the form of hydraulic rams 20, 22 which are connected to bulldozer 16 as shown and which are powered and controlled by conventional means. The surfaces 14, 18 are complemental in shape and the same are configured for drawing a preferably elongated metal sheet work piece 23 placed therebetween into a predetermined shape when the female forming surface 18 of the bulldozer 16 is moved toward and against the male forming surface 14 of the die 12. The sheet 23 may be oriented in any number of ways relative to the longitudinal axis of the machine 10; however, in accordance with the preferred aspects of the invention, the sheet 23 may be placed in machine 10 in such a way that its longitudinal axis is generally parallel to the longitudinal axis of the machine 10.

The machine 10 also includes a pair of spaced apart stretching devices 24, 26 located at respective opposite ends of the machine base 11. Each device 24, 26 includes a respective gripper 24*a*, 26*a*. The grippers 24*a*, 26*a*, which are shown schematically in FIG. 1, preferably use a wedge type action to grip the respective opposite ends 23*a*, 23*b* of the metal sheet 23. Such grippers are conventional and may be purchased from several manufactures known to those skilled in the stretch draw art. Each device 24, 26 also includes a conventional powering mechanism for pulling the grippers 24*a*, 26*a* relatively away from one another so as to stretch the metal sheet 23 in a longitudinal direction.

The machine 10 is used for performing a draw stretch process in accordance with the invention for shaping a workpiece which as mentioned above preferably consists of an elongated metal sheet such as the sheet 23. In accordance with the invention, the metal sheet 23 is placed in a position for being formed in machine 10. The sheet 23 is preferably positioned between bulldozer 16 and die 12 with its major plane generally parallel to the ground and with its longitudinal axis arranged in general parallelism with the base 11 of machine 10. As can be seen from FIG. 1, the sheet 23 is also positioned such that its ends 23*a*, 23*b* project laterally outwardly beyond surfaces 14, 18 and toward the respective grippers 24*a*, 26*a*.

Figure 2A:
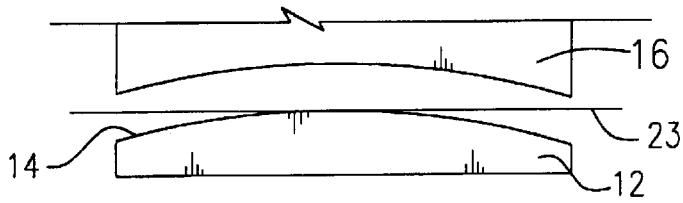
FIGS. 2A, 2B and 2C are partial schematic views illustrating the operational positions of the bulldozer during the process of the invention.
Figure 2B:
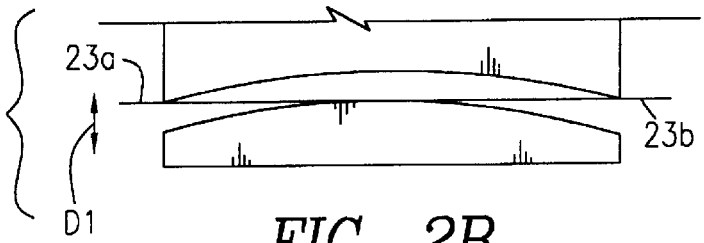

At the beginning of the process, as shown schematically in FIG. 2A, the bulldozer 16 is in a fully open position providing enough space between bulldozer 16 and die 12 for positioning the sheet 23 in the machine 10. At this point the sheet 23 rests on the high points of the male forming surface 14 of the die 12. The bulldozer 16 is then moved toward die 12 until the female forming surface 18 just comes into contact with sheet 23. This position of the bulldozer 16, which is illustrated schematically in FIG. 2B, is its draw initiating position because any further movement of the bulldozer 16 toward die 12 will cause the complemental surfaces 14, 18 to begin drawing and shaping the work piece 23. The bulldozer 16 is stopped in its FIG. 2B draw initiating position and the stretching devices 24, 26 are actuated so as to exert enough pull on ends 23*a*, 23*b* to remove all of the slack from sheet 23. It is important to note here, that in accordance with the preferred aspects of the invention, the devices 24, 26 do not at this point exert any substantial stretching forces on the sheet 23.

Figure 2C:
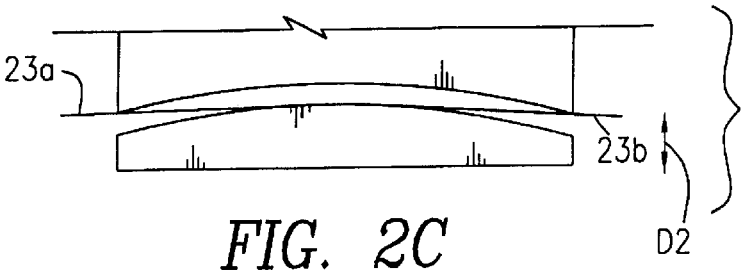

After the slack has been removed from the sheet 23, the same is partially drawn by moving the bulldozer 16 toward the die 12 until it reaches a working position as illustrated schematically in FIG. 2C. As can be seen from FIGS. 2A, 2B and 2C, the working position of the bulldozer 16 is located between the draw initiating position illustrated schematically in FIG. 2B and the fully closed position illustrated schematically in FIG. 1. After the bulldozer 16 has reached its FIG. 2C working position, the partially drawn work piece 23 is stretched by pulling outwardly on the ends 23*a*, 23*b*. The stretching at this point is continued until any puckering or gathers in the work piece 23 are relieved. Such puckering and/or gathering is often caused by friction lock as is well known in the art. The puckering or gathering occurs at areas where the work piece is trying to compress or shrink. This results in wrinkles and the like that tend to prevent the bulldozer from closing completely. It is to be noted here, that one of the special features of the present invention, is the provision of a way to deal with the problems previously resulting from friction lock and undesirable puckering and gathering caused thereby.

In accordance with the process of the invention, the bulldozer 16 is eventually moved into its fully closed position as illustrated in FIG. 1. When the bulldozer 16 and the die 12 are in their FIG. 1 fully closed positions, the work piece 23 will have been forced into its final predetermined shape. It is to be noted here that the movement of the bulldozer 16 from its FIG. 2C working position to its final FIG. 1 fully closed position may take place contemporaneously with the stretching to relieve puckering and/or gathering. Alternatively, movement of the bulldozer 16 from its FIG. 2C working position to its final FIG. 1 filly closed position may take place after the stretching to relieve puckering and/or gathering has been completed. In either case, the puckering and/or gathering is preferably fully relieved before the bulldozer 16 and the die 12 reach their FIG. 1 fully closed positions. It is to be noted that the FIG. 2B draw initiating position of the bulldozer 16 and the FIG. 1 filly closed position thereof are spaced apart a predetermined distance depending upon the depth of the particular draw needed.

In further accordance with the invention, the shaped work piece 23 is again stretched after the bulldozer 16 reaches its fully closed position by pulling the ends 23*a*, 23*b* outwardly to thereby give the shaped work piece 23 memory, to set its shape, and to work harden the same.

During the conduct of the draw stretch process of the present invention, the bulldozer 16 travels a distance D1 as it moves from its FIG. 2B draw initiating position to its FIG. 1 fully closed position. This distance is illustrated schematically by an arrow labeled D1 in FIG. 2B. In addition, the bulldozer 16 travels a distance D2 as it moves from its FIG. 2C working position to its FIG. 1 fully closed position. This distance is illustrated schematically by an arrow labeled D2 in FIG. 2C. Thus, the bulldozer 16 travels a distance D1–D2 as it moves from its FIG. 2B draw initiating position to its FIG. 2C working position. In a preferred form of the invention, the FIG. 2C working position of the bulldozer 16 is closer to the FIG. 1 fully closed position thereof than it is to the FIG. 2B draw initiating position. That is to say, the distance D1–D2 is greater than the distance D2. More preferably, the ratio of distance D1–D2:distance D2 may range from about 1.5:1 to about 19:1, may more preferably range from about 2.33:1 to about 9:1, may even more preferably range from about 4:1 to about 7:1 and ideally may be approximately 5.67:1. It is to be noted that the ideal ratio for each shape and material must generally be determined empirically.

The total stretch applied to the work piece during the process by a combination of stretching and drawing must be greater than the yield strength of the particular metal from which the work piece is made but less than the ultimate strength. These criteria are well known to the routineers in the stretch draw forming art. Often it is necessary to develop the criteria for a given shape and a given metal empirically by trial and error. The controlling limitations in connection with the present invention are simply that the first stretching operation must be sufficient to substantially relieve puckering and gathering of the metal before the draw is completed and that the final stretching operation at the end of the process must be sufficient to fully work harden the material to erase all prior memory and set its final shape. In connection with the foregoing, it is to be noted that each lot of material will be a little different than others and the requirements will change as the properties change from lot to lot. These properties normally fall within a small range for a particular grade and alloy, but the worker in this art will appreciate that the forming process will not be uniform over the entire surface of the material because the shape determines those areas that will require more or less localized stretching. The critical objectives are therefore to avoid the formation of wrinkles and the like during the forming process and to avoid exceeding the capacity of the material when stretching. It has been found to be helpful in accomplishing the purposes of the invention to coat the female forming surface 18 of the bulldozer 16 with a glass system which is softer than usual to allow for a slight bit of flex and deformity so that the female surface 18 of the bulldozer 16 and the male surface 14 of the die 12 may, when the bulldozer 16 and the die 12 are in their respective fully closed positions, achieve a completely nested position with the formed workpiece therebetween.

Figure 3:
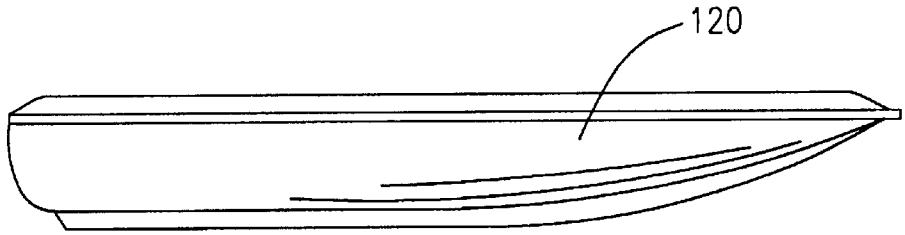
FIGS. 3, 4 and 5 are respectively side elevational, front end and bottom views illustrating a boat hull constructed using the process of the invention.
Figure 4:
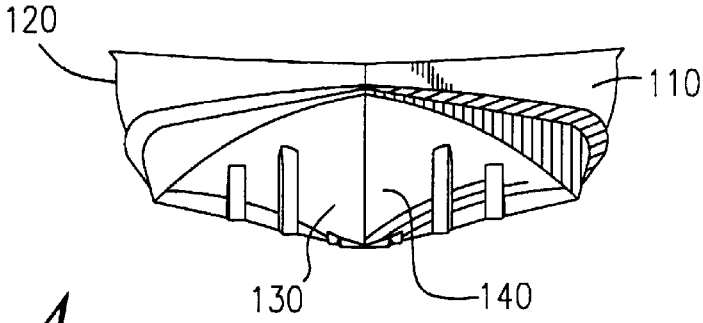
Figure 5:
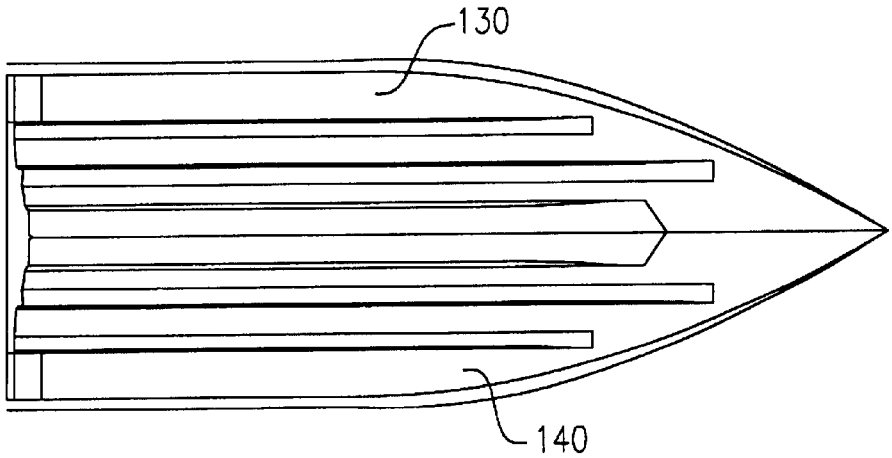

In a further preferred form of the invention, the metal of the work piece may be a aluminum, preferably a corrosion resistant aluminum and ideally may be 5052 aluminum. In a particularly preferred form of the invention, the formed work piece may be at least a portion of a boat hull. In this latter regard, a boat 100 formed through the use of the invention is illustrated in FIGS. 3, 4 and 5. The boat 100 may in some instances consist of four separate portions 110, 120, 130 and 140 which may each be formed by the process of the invention. Thus, the sides 110, 120 and the bottom portions 130 and 140 may be formed separately using the process of the invention and then the same may be welded together to form the boat 100. The boat 100 may preferably be at least 15 feet long and even more preferably may be greater than 20 feet long. Thus, each of the portions 110, 120, 130 and 140 may be made from a separate sheet 23 which is at least 15 and preferably is at least 20 feet in length. Generally speaking, rectangular pieces of material that are about 260" long by about 69" wide by about 0.105 to 0.125" thick have been found to be suitable for forming boat components such as the parts 110, 120, 130 and 140 using the processes of the invention. Material right off a commercially available coil may be used in forming the parts 110, 120, 130 and 140 so as to maximize the available yield. The forming is then done in accordance with the invention in a single operation that will net a work hardened piece of material with the desired shape and properties.

Although the boat in the foregoing example is made up of four separate pieces formed in accordance with the invention, it may be desirable to form other boats with other shapes from a fewer or greater number of individual pieces of formed aluminum. For example, it may be possible in accordance with the invention to form a boat using only two pieces which are joined together by a single longitudinally extending central weld.

In accordance with the invention, the material to be draw stretched formed is cut to length and loaded into the stretch draw machine, the material is then pulled tight with as little stretch as possible. At this point the bulldozer is driven on to the material nearly to its final position, and as the pressure is increased on the bulldozer thereafter, the material is stretched from the ends. When the bulldozer has reached its final fully closed position, additional stretch is applied to give the material memory, set the shape, and achieve the additional work hardening desired. The end result is a product that has been fully work hardened while in the desired shape. This results in a product which is superior in quality and properties as opposed to material that has been hardened and then shaped in accordance with prior art processes.

We claim:

1. A draw stretch process for shaping a work piece initially comprising an elongated metal sheet having a pair of spaced opposite ends, said process comprising:

placing said metal sheet in a metal forming position in a draw stretch forming machine between a bulldozer having a female forming surface and a die having a male forming surface, said sheet being positioned such that said ends thereof project laterally outwardly beyond said surfaces, said surfaces being complemental and configured to draw said metal sheet into a predetermined shape, said bulldozer being movable relatively toward the die from a draw initiating position where it is adjacent the metal sheet to a fully closed metal sheet shaping position, said draw initiating position and said fully closed position being spaced apart a predetermined distance;

partially drawing the workpiece by moving said bulldozer toward said die with the workpiece therebetween a distance D1 from said draw initiating position to a working position located between said draw initiating position and said fully closed position;

stretching the partially drawn work piece by pulling outwardly on said ends thereof after the bulldozer has reached said working position and continuing said stretching until any puckering or gathers in the workpiece are relieved;

completing the drawing of the work piece by moving the bulldozer toward said die with the relieved work piece therebetween a distance D2 from said working position to said fully closed position to thereby give said work piece its final predetermined shape; and stretching the shaped work piece again by pulling outwardly on the ends thereof after the bulldozer has reached said fully closed position to thereby give the shaped work piece memory, to set its shape, and to work harden the same;

wherein the ratio of D1:D2 ranges from about 1.5:1 to about 19:1.

2. A method as set forth in claim 1, wherein the ratio of D1:D2 ranges from about 2.33:1 to about 9:1.

3. A method as set forth in claim 2, wherein the ratio of D1:D2 ranges from about 4:1 to about 7:1.

4. A method as set forth in claim 3, wherein the ratio of D1:D2 is approximately 5.67:1.

5. A method as set forth in claim 1, wherein said metal is a corrosion resistant aluminum.

6. A method as set forth in claim 5, wherein said metal is 5052 aluminum.

7. A method as set forth in claim 1, wherein said formed work piece is at least a portion of a boat hull.

8. A method as set forth in claim 6, wherein said formed work piece is at least a portion of a boat hull.

9. A method as set forth in claim 1, wherein said sheet is at least about 15 feet long.

10. A method as set forth in claim 9, wherein said sheet is at least about 20 feet long.

11. A method as set forth in claim 8, wherein said sheet is at least about 15 feet long.

12. A method as set forth in claim 11, wherein said sheet is at least about 20 feet long.

* * * * *